United States Patent [19]

Sando et al.

[11] 4,240,276

[45] Dec. 23, 1980

[54] SEAL DEVICE

[75] Inventors: Yoshikazu Sando; Hiroshi Ishidoshiro, both of Wakayama, Japan

[73] Assignee: Sando Iron Works Co., Ltd., Tokyo, Japan

[21] Appl. No.: 91,170

[22] Filed: Nov. 5, 1979

[30] Foreign Application Priority Data

Nov. 7, 1978 [JP] Japan ..... 53-137003

[51] Int. Cl.[3] ..... D06B 23/18

[52] U.S. Cl. ..... 68/5 E; 68/181 R

[58] Field of Search ..... 68/5 E, 22 B, 22 R, 68/175, 177, 178, 179, 181 R, 184

[56] References Cited

U.S. PATENT DOCUMENTS

| | | | |
|---|---|---|---|
| 3,986,831 | 10/1976 | von der Eltz et al. | 68/5 E X |
| 4,041,559 | 8/1977 | von der Eltz | 68/5 E X |

FOREIGN PATENT DOCUMENTS

| | | | |
|---|---|---|---|
| 41-5831 | 3/1966 | Japan | 68/5 E |

*Primary Examiner*—Philip R. Coe

*Attorney, Agent, or Firm*—Toren, McGeady and Stanger

[57] ABSTRACT

A seal device provided with a pair of seal rubber rolls arranged to seal a cloth material inlet or outlet formed in a steamer drum body for hygro-thermic treatment of a cloth material. The seal device has a tubular cloth material passage which extends upward at least 400 mm above the seal rubber rolls and has an opening at the lower end thereof abutting the rubber rolls, the transverse width of the opening is a little larger than the breadth of the cloth material to be processed and a longitudinal width of the opening measures about 3 mm; a liquid supply mechanism adjoins the inlet of the cloth material passage; and a pair of weir plates are disposed within the liquid supply mechanism on both sides of the cloth material passing therethrough and are arranged to permit adjustment of the gap between them for allowing the cloth material to pass therethrough.

2 Claims, 6 Drawing Figures

SEAL DEVICE

BACKGROUND OF THE INVENTION

1. Field of the Invention

This invention relates to a seal device of a high pressure steamer adapted for dyeing a cloth material.

2. Description of the Prior Art

Generally, cloth materials are dyed by immersing them in hot water or by subjecting them to a steaming process after a dye is applied to them. Heretofore, after dye is applied to a cloth material to be dyed by passing the cloth material through a dye solution tank, for example, the cloth material is subjected to a hygro-thermic treatment carried out within a steamer at a temperature not exceeding 100° C. for color development. Accordingly, the conventional dyeing method has necessitated the use of a dye solution applying tank, a vat steamer and a washing tank. This requires a great amount of installation cost and a large space for installation. Besides, in accordance with the conventional method of carrying out a dyeing process at a temperature not exceeding 100° C., a long period of time is required and is thus not economical.

In an effort to shorten the period of time required for dyeing, the present inventors have long conducted researches for a high speed dyeing process. As a result of this effort, they have developed a high pressure steamer which is capable of dyeing a cloth material within a short period of time in the order of seconds and is presently in actual services. In the case of dyeing with this high pressure steamer, the temperature of the humid heat within the high pressure steamer can be raised up to 170° C. or thereabout to carry out dyeing a cloth material in such a short period of time. However, the high pressure steamer has a large size requiring a large space for installation and is expensive. Besides, in starting up the operation of the high pressure steamer, the temperature and the pressure within the steamer must be raised up to predetermined values, which cannot be reached in a short period of time. Thus, the high pressure steamer takes a long period of time for preparation before start-up.

Further, in order to raise the temperature within the steamer up to 170° C., the high pressure humid heat within the steamer is maintained by supplying air pressure to the seal device of the steamer to have the air pressure counteract the pressurized steam contained in the inside of the steamer. However, with the air pressure used for this purpose, a portion of the air pressure mixes with the steam within the steamer. Accordingly, in cases where a color is to be developed with a threne or indanthrene dye, the dye fixing effect of a reducing agent employed is lowered by the air or oxygen thus mixed in the steam within the steamer. Further, such a reducing agent does not effectively bring forth color development at a high temperature exceeding 120° C. The present invention is directed to the solution of these problems of the prior art.

SUMMARY OF THE INVENTION

It is an object of this invention to provide a seal device which is applicable to a high pressure steamer arranged to maintain therein humid heat of 110° C. or thereabout to advantageously effect fixation of a reactive dye and which is not only of simple construction but also requires no supply of air pressure for sealing.

The above and other objects, features and advantages of the invention will become apparent from the following detailed description of embodiments thereof taken in connection with the accompanying drawings.

BRIEF DESCRIPTION OF THE DRAWINGS

The accompanying drawings illustrate preferred embodiments of the present invention.

DETAILED DESCRIPTION OF PREFERRED EMBODIMENTS

Figure 1:
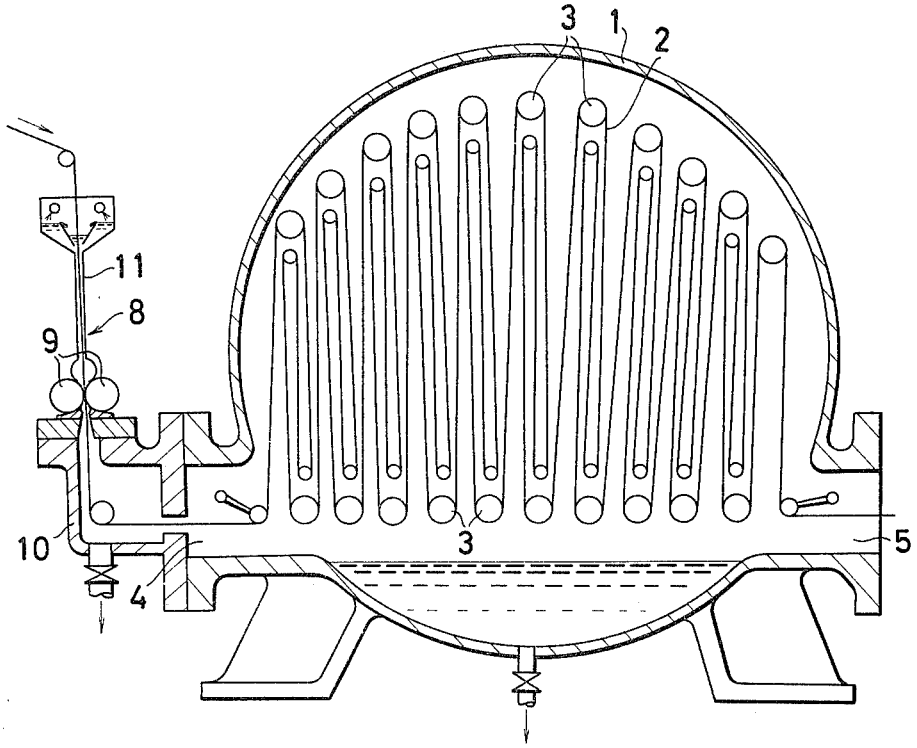
FIG. 1 is a sectional view showing a high pressure steamer equipped with a seal device as embodiment of the invention.
Figure 3:
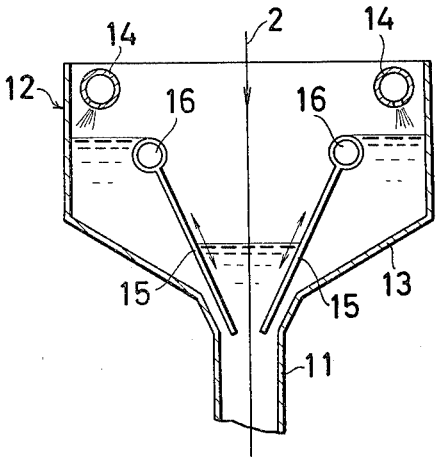
FIG. 3 is an enlarged sectional view showing a liquid supply mechanism used for the seal device.
Figure 4:
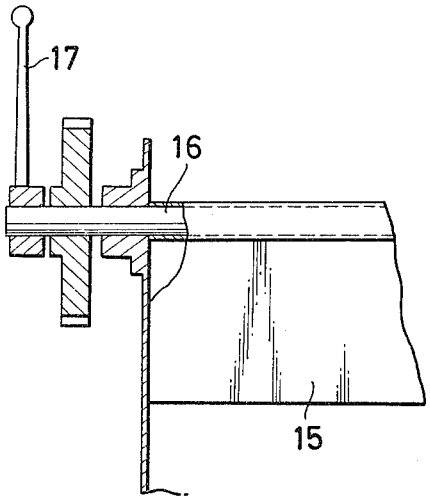
FIG. 4 is a sectional view showing a part of the liquid supply mechanism.

In FIG. 1, a steamer drum body 1 is provided with many guide rolls 3 which are arranged within the drum body 1 to have a cloth material 2 move up and down in a zigzag manner. The steamer drum body 1 is provided also with a cloth material inlet 4 and a cloth material outlet 5. The outlet 5 is provided with a seal device which includes a slow cooling tank 6. The structural arrangement of this seal device is known and is, therefore, not illustrated and is omitted from description herein. A seal device 8 which is the subject matter of the present invention is provided at the inlet 4 of the steamer drum body 1. The seal device 8 is arranged in the following manner: A pair of seal rubber rolls 9 which are arranged to close the inlet 4 are rotatably carried by a seal block 10 in a state of being in pressed contact with each other. A cloth material passage 11 extends upward from the seal rubber rolls 9. The sectional shape of this cloth material passage 11 is arranged to be somewhat wider than the breadth of the cloth material and somewhat thicker than the thickness of the cloth material and thus measures, for example, about 3 mm in longitudinal width. The lower end of the cloth material passage 11 abuts the seal rubber rolls 9 to prevent liquid supplied to the inside of the cloth material passage 11 from leaking there. At the upper end of the cloth material passage 11, there is formed a liquid supply mechanism 12. The structural arrangement of the liquid supply mechanism 12 is as shown in FIGS. 3 and 4. Referring to FIG. 3, a liquid reservoir 13 opens to the cloth material passage 11. Above the liquid reservoir 13, there are provided liquid supply tubes 14 which are positioned on both sides of the cloth material 2 which passes through the liquid reservoir 13. Within this liquid reservoir 13, there are provided a pair of weir plates 15 which are arranged to tilt or converge toward each other in the downward direction. These plates 15 are carried by supporting shafts 16 which are arranged such that the gap between the pair of weir plates 15 are adjustable by rotating these supporting shafts 16. Each of the supporting shafts 16 is provided with a handle 17, which is secured to one end of the shaft 16 and is arranged to permit a rotating operation on the supporting shaft for adjustment of each plate 15 as shown in FIG. 4.

Figure 5:
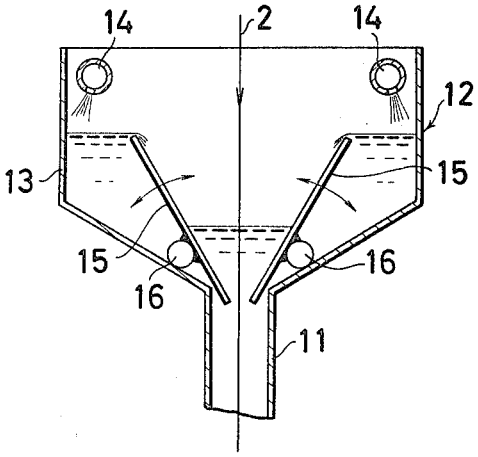
FIG. 5 is a sectional view showing a liquid supply mechanism as another embodiment.

In this embodiment, the supporting shafts 16 are secured to the upper ends of the weir plates 15, respectively. However, the present invention is not limited to such arrangement and the supporting shafts 16 may be disposed at the lower ends of the weir plates 15 as shown in FIG. 5.

Figure 6:
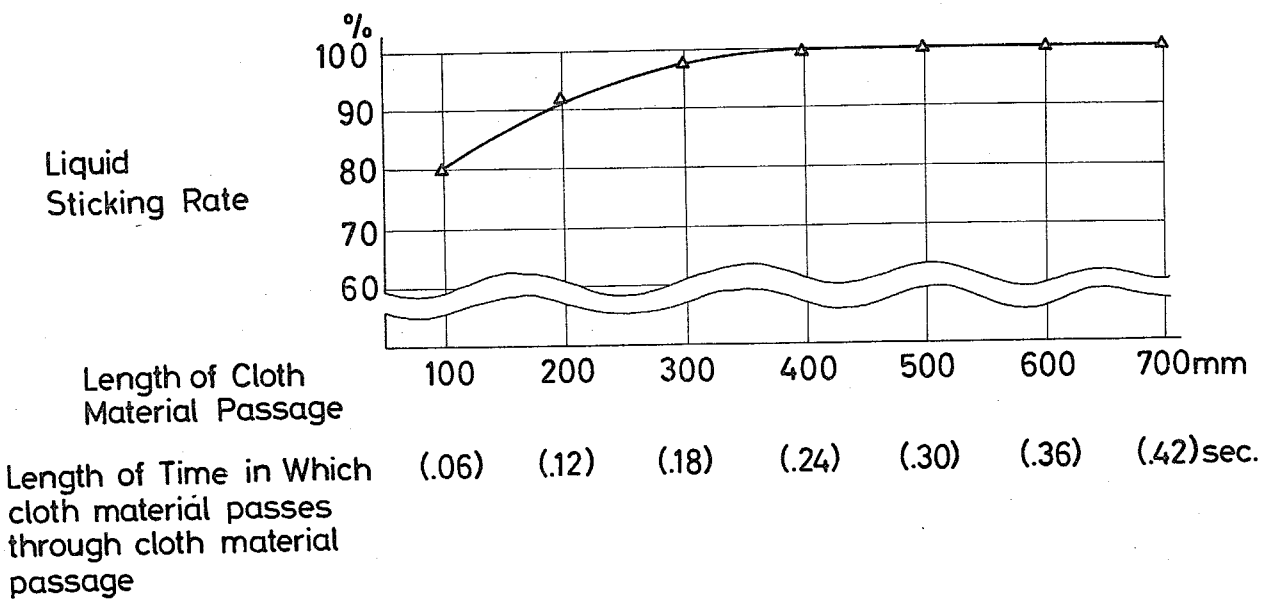
FIG. 6 is a graphical representation showing the relation of the length of a cloth material passage to a liquid sticking rate.

Further, as apparent from the data shown in FIG. 6, in order to sufficiently and homogeneously impregnate the cloth material with the liquid provided within the cloth material passage 11 while the cloth material is passing therethrough, it is necessary to have the cloth material passage 11 measure at least 400 mm in length.

The operation of the embodiment is as follows: The cloth material 2 is passes through the cloth material passage 11. Next, a desired liquid is gradually supplied to the inside of the cloth material passage 11 from the liquid supply tubes 14 through the liquid reservoir 13 in such a way as not to have the liquid overflow from the liquid reservoir 13. Then, the cloth material 2 is allowed to move on through the liquid with which the cloth material passage is filled. The cloth material 2 is sufficiently impregnated with the liquid before it comes out of the cloth material passage 11. Following this, the cloth material is squeezed by the seal rubber rolls 9 to have the liquid wrung out of it before it is allowed to travel within the steamer drum body 1.

As described in the foregoing, in accordance with the present invention, the cloth material passage 11 extends above the seal rubber rolls 9 up to a height at least 400 mm from the upper sides of the rubber rolls. Since the cloth material passage 11 is with liquid such as a dye solution, the action of the liquid pressure within the cloth material passage 11 in conjunction with the sealing action of the seal rubber rolls 9 effectively serves to maintain high pressure and a temperature of about 110° C. within the steamer drum body 1. Further, unlike the conventional arrangement, with the supply of sealing air dispensed with, there is no possibility of having the air mixed in the steam contained in the steamer drum body 1, so that dyeing can be effectively carried out without having a reducing agent affected by the air when a reactive dye is employed for dyeing.

Since the distance of the gap between the two weir plates 15 is adjustable by operating the handles 17, the distance can be readily adjusted in accordance with the thickness of the cloth material to be processed. Therefore, this arrangement not only permits uniformly impregnation of various kinds of cloth materials with the liquid but also enhances the sealing effect.

Further, since the volume of the inside of the cloth material passage 11 is arranged to be as small as possible, the liquid within the cloth material passage 11 is almost completely absorbed by the cloth material, thus leaving not much residual liquid there. Therefore, the liquid can be prevented from being wasted when it is replaced and this eliminates the possibility of environmental contamination with a waste liquid.

Figure 2:
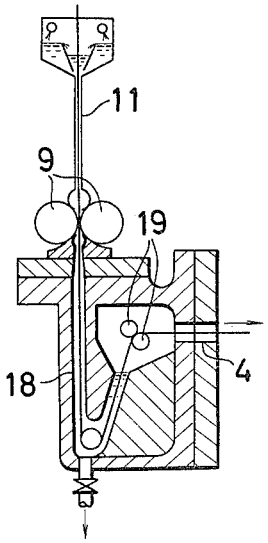
FIG. 2 is a sectional view showing a seal device as another embodiment of the invention.

In the embodiment described in the foregoing, the cloth material passage 11 is arranged to extend upward above the outer side of the seal rubber rolls 9. However, the present invention is not limited to this arrangement. As shown in FIG. 2, a second cloth material passage 18 may be vertically arranged in a void space between the seal rubber rolls 9 and the inlet 4 of the steamer drum body 1. With the second cloth material passage arranged in this manner, the sealing effect can be further enhanced by the liquid pressure within the first cloth material passage 11 and that of the second cloth material passage 18 and thus the passing cloth material is more thoroughly impregnated with the liquid.

What is claimed is:

1. A seal device to be provided with a pair of seal rubber rolls for closing a cloth material inlet or outlet formed in a steamer drum body adapted for hygro-thermic treatment of a cloth material, said seal device comprising:

a tubular cloth material passage extending upward at least 400 mm above the outer side of said seal rubber rolls and having the lower end thereof provided with an opening which abuts on said rubber rolls, said opening having a transverse width a little wider than the breadth of said cloth material and measuring 3 mm or thereabout in longitudinal width;

a liquid supply mechanism adjoining the inlet part of said cloth material passage; and a pair of weir plates disposed within said liquid supply mechanism and each said weir plate being located on an opposite side of said cloth material passing therethrough, said weir plates being in spaced relation forming a gap therebetween through which the cloth material passes, means connected to said weir plates and arranged to permit adjustment of said gap by moving said weir plates toward or away from one another thereby varying said gap.

2. A seal device to be provided with a pair of seal rubber rolls for closing a cloth material inlet or outlet formed in a steamer drum body adapted for hygro-thermic treatment of a cloth material, said seal device comprising:

a first tubular cloth material passage extending upward above the outer side of the seal rubber rolls and having the lower end thereof provided with an opening which abuts said rubber rolls, said opening having a transverse width a little wider than the breadth of said cloth material and measuring 3 mm or thereabout in longitudinal width;

a liquid supply mechanism adjoining the inlet part of said first cloth material passage;

a pair of weir plates disposed within said liquid supply mechanism and each said weir plate being located on an opposite side of said cloth material passing therethrough, said weir plates being in spaced relation forming a gap therebetween through which the cloth material passes, means connected to said weir plates and arranged to permit adjustment of said gap by moving said weir plates toward or away from one another thereby varying said gap; and a second tubular cloth material passage having the upper end thereof provided with an opening which abuts said seal rubber rolls on the opposite side thereof from said first tubular passage, said opening having a transverse width a little wider than the breadth of said cloth material and measuring 3 mm or thereabout in longitudinal width, the sum of the length of said first cloth material passage and of said second cloth material passage measuring at least 400 mm.

* * * * *